US007302710B2

(12) United States Patent
Thomas et al.

(10) Patent No.: US 7,302,710 B2
(45) Date of Patent: Dec. 4, 2007

(54) HOODED GARMENT WITH CIRCULAR KNITTED COLLAR

(75) Inventors: Edward Brooks Thomas, Bowling Green, KY (US); Danny C. Munford, Bowling Green, KY (US)

(73) Assignee: Fruit of the Loom, Inc., Bowling Green, KY (US)

( * ) Notice: Subject to any disclaimer, the term of this patent is extended or adjusted under 35 U.S.C. 154(b) by 213 days.

(21) Appl. No.: 10/636,737

(22) Filed: Aug. 8, 2003

(65) Prior Publication Data

US 2005/0028242 A1 Feb. 10, 2005

(51) Int. Cl.
*A42B 1/00* (2006.01)

(52) U.S. Cl. ..... 2/84; 8/202

(58) Field of Classification Search ..... 2/455, 2/410, 4, 424, 69, 69.5, 9, 77, 82–98, 102, 2/103, 108, 171, 113–116, 127, 129, 173, 2/918, 202–207

See application file for complete search history.

(56) References Cited

U.S. PATENT DOCUMENTS

| | | | | | |
|---|---|---|---|---|---|
| 2,129,454 | A * | 9/1938 | Wilkie | 2/84 |
| 2,682,056 | A * | 6/1954 | Werber | 2/84 |
| 2,834,966 | A * | 5/1958 | Zimmerman | 2/84 |
| 3,389,407 | A * | 6/1968 | Morrison | 2/84 |
| 3,698,014 | A * | 10/1972 | Little et al. | 2/84 |
| 4,329,742 | A * | 5/1982 | Schuessler | 2/424 |
| 4,603,440 | A * | 8/1986 | Hale | 2/115 |
| 4,944,041 | A * | 7/1990 | Buenos et al. | 2/84 |
| 5,077,838 | A * | 1/1992 | Senser | 2/69 |
| 5,115,517 | A * | 5/1992 | Ferguson et al. | 2/203 |
| 5,182,812 | A * | 2/1993 | Goldsby | 2/79 |
| 5,664,259 | A * | 9/1997 | Budd | 2/115 |
| 5,713,077 | A * | 2/1998 | Humbrecht | 2/173 |
| 5,815,833 | A * | 10/1998 | Kuo | 2/69.5 |
| 5,845,340 | A * | 12/1998 | Frislie | 2/202 |
| 6,023,787 | A * | 2/2000 | French et al. | 2/202 |
| 6,314,581 | B1 * | 11/2001 | Bond | 2/129 |
| 6,397,395 | B1 * | 6/2002 | DeHart | 2/206 |
| 6,611,960 | B2 * | 9/2003 | Kim | 2/129 |
| 6,654,963 | B2 * | 12/2003 | Fayle et al. | 2/84 |
| 6,665,878 | B1 * | 12/2003 | Way | 2/84 |
| 7,028,345 | B2 * | 4/2006 | Waldman | 2/468 |
| 2003/0154536 | A1 * | 8/2003 | Anderson et al. | 2/108 |
| 2004/0064869 | A1 * | 4/2004 | Deadwyler | 2/115 |
| 2004/0187186 | A1 * | 9/2004 | Boezi | 2/84 |
| 2005/0160514 | A1 * | 7/2005 | Flaniken | 2/84 |
| 2006/0143797 | A1 * | 7/2006 | Waldman | 2/202 |

* cited by examiner

*Primary Examiner*—Alissa Hoey
(74) *Attorney, Agent, or Firm*—Harness, Dickey & Pierce, P.L.C.

(57) ABSTRACT

A garment for protecting the head and neck of a user including a garment body with a neck opening. A hood attached to the garment body. A stretchable tubular knitted collar, attached to the garment body approximate to the neck opening of the garment body and inside at least a portion of the hood.

10 Claims, 9 Drawing Sheets

HOODED GARMENT WITH CIRCULAR KNITTED COLLAR

BACKGROUND OF THE INVENTION

1. Field of the Invention

The present invention relates to the field of hooded garments, and particularly to a garment having an integrated hood and circular knitted collar.

2. Background of the Invention

Many types of cool or cold weather apparel exist for protecting a wearer's upper torso, including coats, sweaters, sweatshirts, and other similar outerwear. In many cases, different items of apparel may be worn together, such as a coat and a hat, to improve the overall protection for the wearer. Similarly, certain apparel may combine features, such as a coat liner or removable hood, to increase the circumstances in which the apparel might be appropriately used.

It is well known that a significant percentage of a person's body heat is radiated through his or her head. For this reason, various apparel exist that are designed to cover the head and neck when worn. Among these various items of apparel include face mask, hats, caps, knitted hats, and others. As discussed generally above, at least some of these head and neck protections have been combined with coats and jackets.

In addition to separate apparel, in some designs, outerwear may include combinations of protective elements in an integrated design. For example, some coats, jackets, sweaters, include a hood that is integrally formed or removable. This allows the user to cover the head and neck when exposed to the elements and lower (or remove) the hood when not needed.

In addition to the face and head, protection of the neck is also a desired objective in cool and cold weather garments. For example, scarves are traditionally worn to protect the neck of a wearer during cool or cold weather. The combination of a scarf with a jacket has proven effective in creating a wind barrier for protecting the entire upper torso of a user and to maintain body heat within the combination.

In this same regard, circular knitted fabric collars, commonly known as "turtleneck" collars have been used in other apparel for similar purposes. In essence, the collar comprises a tube formed of porous stretchable knitted fabric connected to a primary garment which covers the torso of the wearer. Not withstanding the collar's stylistic desirability, the turtleneck, similar to the scarf, provides a barrier to prevent wind and other elements from the neck and torso of the user.

However, current apparel designs require wearing combinations of multiple cool and cold weather protection since one garment alone may not be comfortably worn or provide the desired protection needed in a range of temperatures. Depending on the circumstances, users may combine face masks, hooded garments, scarves, turtleneck shirts, long underwear and other garments in combination as a defense against the elements. This is both inconvenient and expensive.

SUMMARY OF THE INVENTION

The present invention is directed to a hooded garment having a stretchable tubular knitted collar for selectively covering a human neck and head. The disclosed apparel design includes a garment body with a neck opening. A retractable hood is attached to the garment body for selectively covering the wearer's head and neck. Attached to the garment body, around the neck opening area and inside at least a portion of the hood, is a stretchable tubular knitted collar. The collar is dimensioned to be positioned between a retracted position covering only a portion of the wearer's neck to an extended position covering a substantial portion of the wearer's neck and face. The combination of the hood with a stretchable tubular knitted collar enables the wearer to cover a substantial portion of their head and neck and also to prevent migration of cold air, rain, snow or other elements from entering the neck opening.

In another aspect of the invention, the stretchable tubular knitted collar is integrally formed with the hood for easy attachment to the garment body.

Finally, in another aspect of the disclosed invention, a method of making a garment with a hood and stretchable tubular knitted neck is disclosed in which the hood and stretchable tubular knitted neck are integrally formed as a unit and later attached to the garment body about the neck opening.

DESCRIPTION OF THE INVENTION

Figure 1:
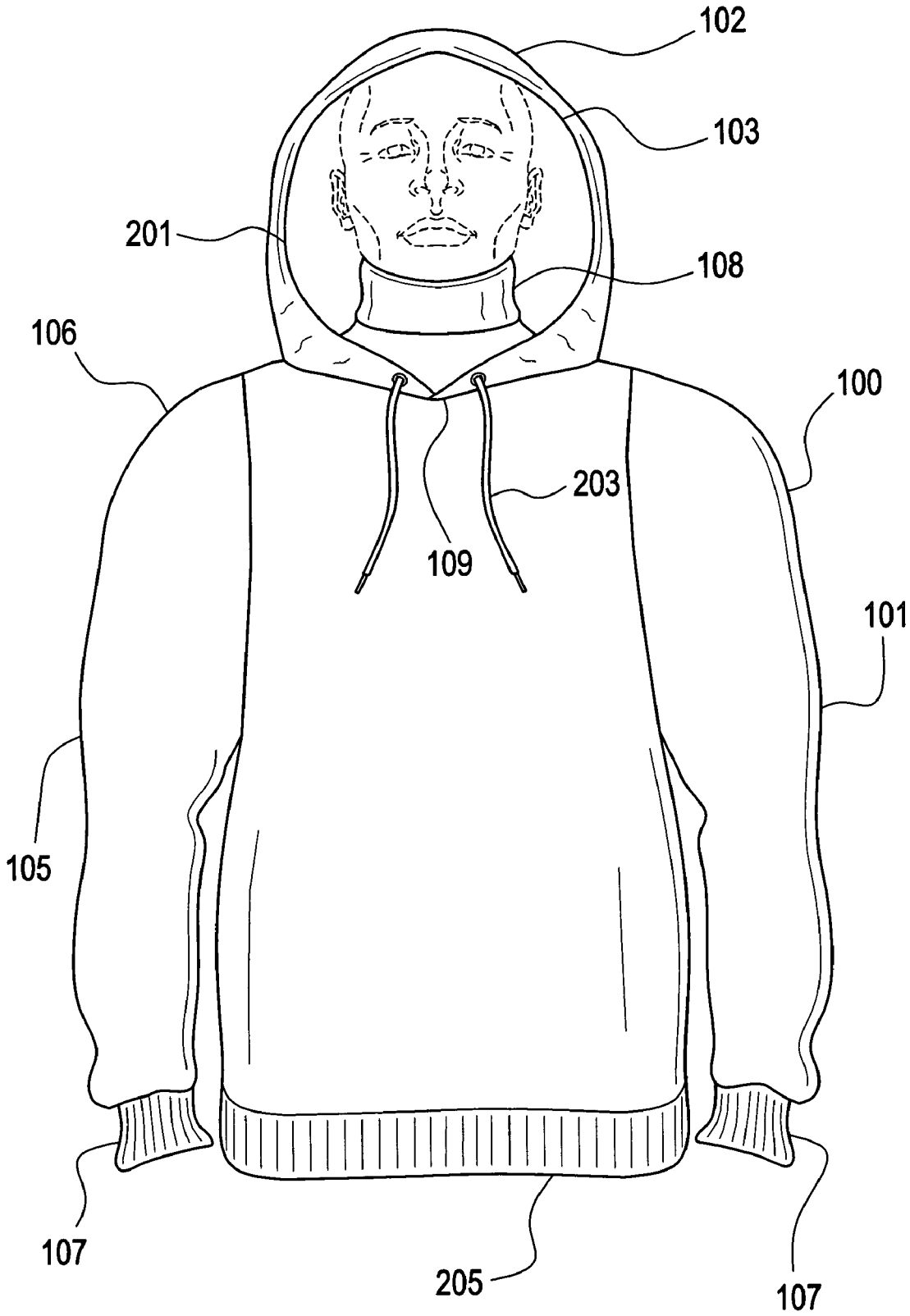
FIG. 1 is a front view of a hooded garment with the stretchable tubular knitted collar in a retracted position with the hood covering the head of the wearer according to a preferred embodiment of the invention.

FIG. 1 illustrates a front view of a hooded garment 100 with an integrally formed stretchable tubular knitted collar 108 and retractable hood 102.

The garment body 101 is designed to cover a substantial portion of the wearer's upper torso with two long sleeved portions 105 for each arm. Each sleeve 105 has a sleeve opening. Stretchable cuffs 107 are attached to the end of each sleeve 105.

In one preferred embodiment, the garment body 101 may be formed of a tubular knitted fabric, such as a 2-end or 3-end fleece. Various patterning may be used to form the constitute elements of the garment body 101. For example, the garment body 101 may have front and rear main panels that are sewn together. Once combined, each of the sleeves 105 may be formed and sewn for later attachment to the combined front and rear panels.

The garment body 101 has four openings. Two openings for each of the two arms. A bottom opening 205 near the wearer's waist and a neck opening for receiving the wearer's neck and head.

A hood 102 is separately formed and connected to the garment body 101. The hood 102 has two openings: one for receiving the head and neck of the wearer and a face opening 103 for allowing the wearer to see through when the collar is in an extended position.

The hood 102 also includes a drawstring 203 which is routed through a channel along the periphery of the face opening 103. A user may reduce the effective size of the face opening 103 by merely pulling the drawstring 104 providing a greater form of protection. The channel is formed by folding back a portion of the hold and sewing the edge of the edge.

In an exemplary embodiment, the garment 100 also includes a stretchable tubular knitted collar 108 having a continuous enclosed surface. The stretchable tubular knitted collar is formed of a circular knitted fabric that may be the same fabric used to form the hood 102 and/or body 106. It is possible for the collar to be of a different fabric. For example, this allows the collar to be formed of fabric having a softer feel than the remainder of the garment. An important feature of the collar 108 is that it possesses sufficient elasticity to snugly, but not uncomfortably, fit about the neck (and/or face) of the wearer.

Once created, the hood 102 and the collar 108 are positioned about the entire neck opening and sewn in place. As shown, a portion of the hood about the neck opening overlaps with itself in the front portion of the hood to complete the face opening in one embodiment.

When attached to the garment body 101, the wearer may cover their head and neck but still see through a face opening 103. The hood 102 is dimensioned such that the wearer may place the hood 102 on their head, while still not interfering with the ability to see through the face opening 103. Depending on the type of garment, the dimension of the hood 102 may be also be formed to simulate the brim of a cap when in use. This allows the user to protect a greater portion of their face if the hood 102 is of a larger dimension.

The collar 108 is dimensioned to extend between a retracted portion and an extended position. As shown in FIG. 1, the collar 108 is in a retracted position below the face of the wearer and about the wearer's neck. The combination of having the hood 102 in an up position with the collar 108 in a retracted position, protects the wearer's head and neck, while leaving the face of the wearer exposed.

As shown in subsequent figures, the retractable collar 108 and hood 102 may be used in various combinations to expand the acceptable range of usage for the garment.

Figure 2:
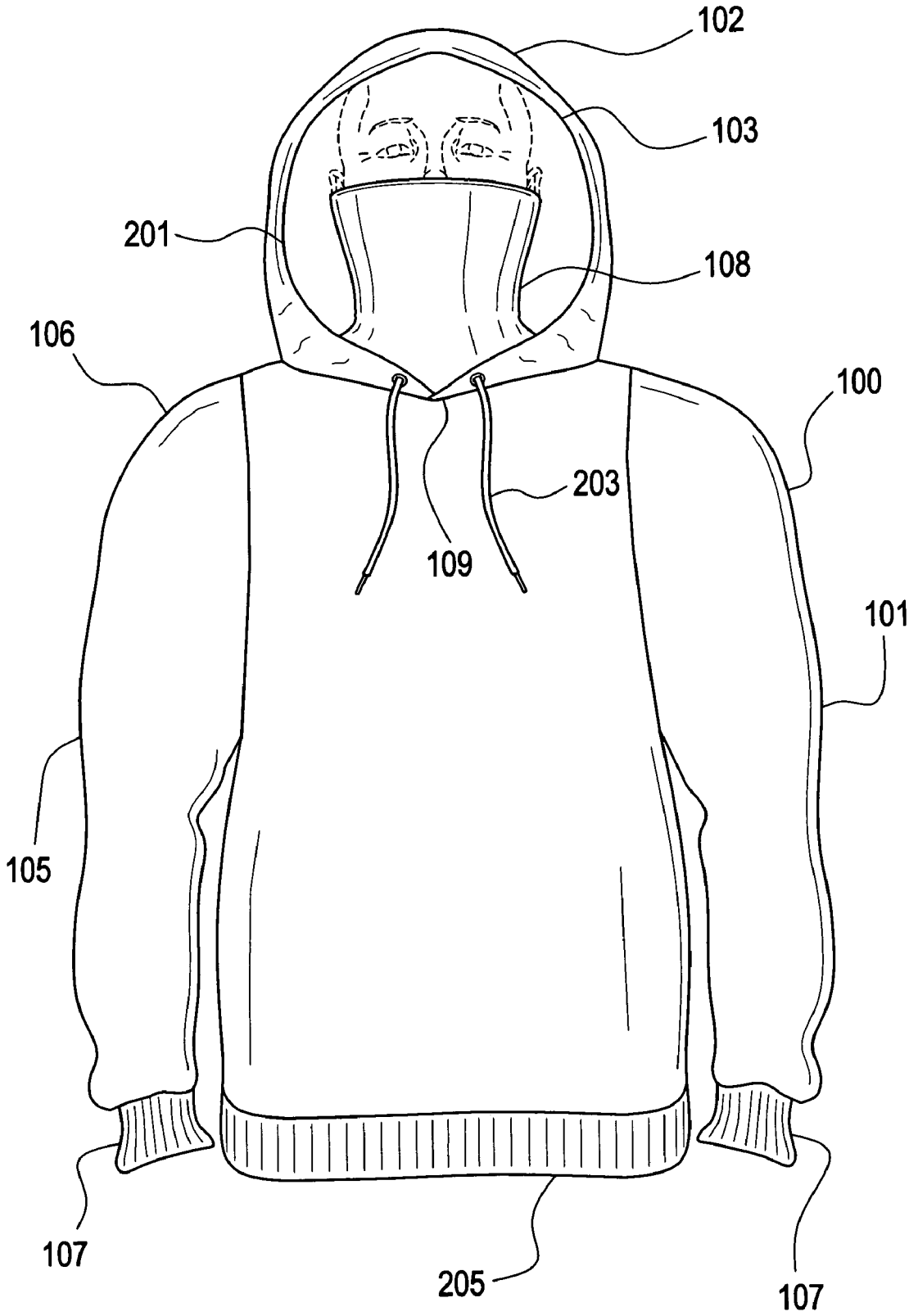
FIG. 2 illustrates a front view of a hooded garment with a stretchable tubular knitted collar, with the stretchable tubular knitted collar in an extended position covering a substantial portion of the user's face and ears, according to a preferred embodiment of the invention.

In contrast with FIG. 1, FIG. 2 shows the same garment as FIG. 1 and similar numerals identify similar elements in FIG. 2. However, in this figure, the stretchable tubular knitted collar 108 is in an extended position that covers a substantial portion of the wearer's face with the hood 102 in an upward position while still allowing him or her to see through the face opening. Thus, said collar having a sufficient height to cover a substantial portion of a wearer's neck in a folded position and to cover a portion of a wearer's face in an unfolded position.

Figure 3:
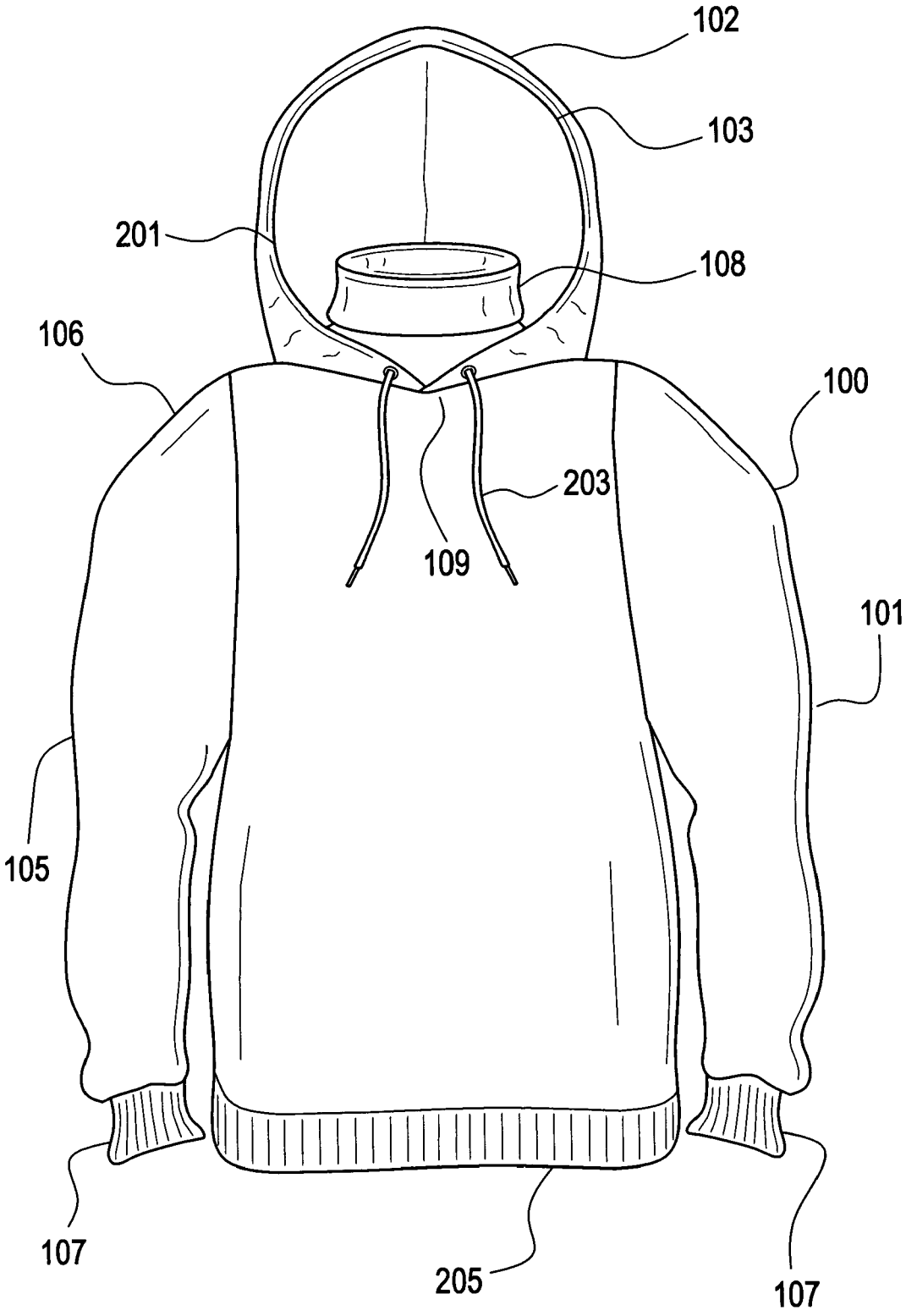
FIG. 3 is a front view of a hooded garment with a stretchable tubular knitted collar, according to a preferred embodiment of the invention.

In FIG. 3, the hood 102 is in an upward position and the collar 108 is in a retracted position. This position offers moderate protection but still leaves the face of the wearer exposed.

Figure 4:
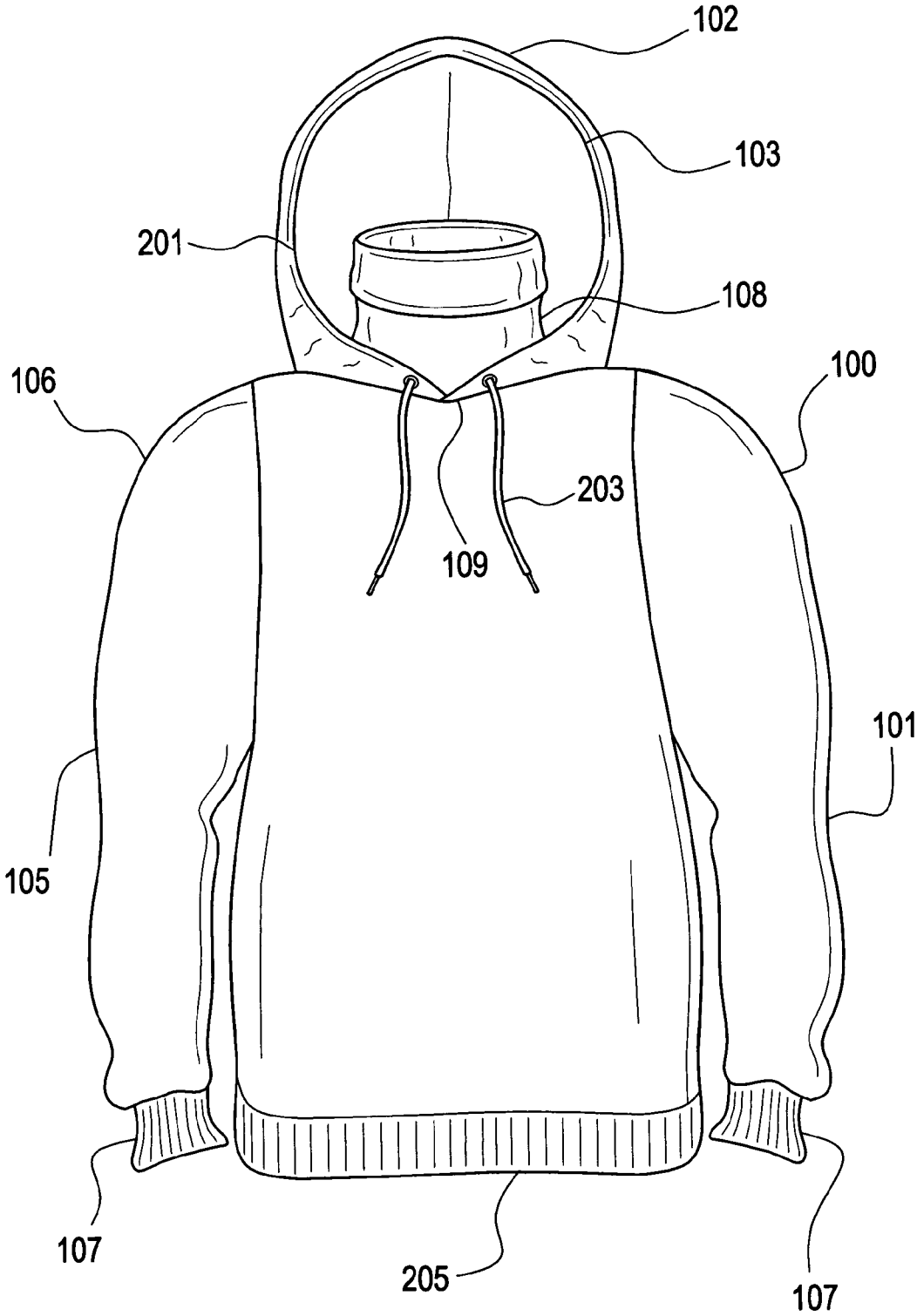
FIG. 4 is a front view of a hooded garment with a stretchable tubular knitted collar in an extended position, according to a preferred embodiment of the invention.

FIG. 4 shows the combination of the extended collar 108 and hood 102 that offers the maximum protection in which a substantial portion of the wearer's face is covered by the extended knitted collar.

Figure 5:
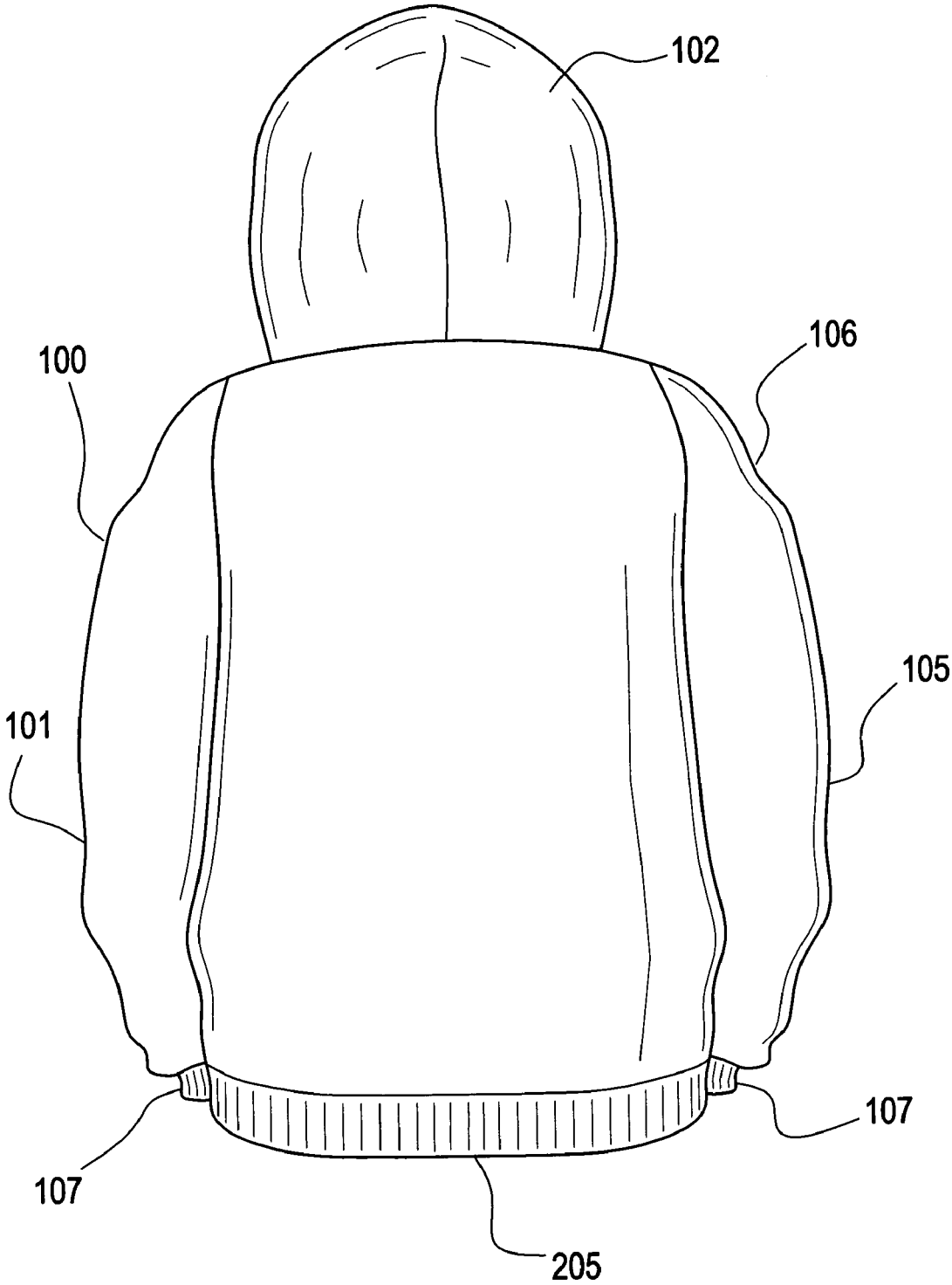
FIG. 5 is a back view of a hooded garment with the hood in an extended upward position, according to a preferred embodiment of the invention.
Figure 6:
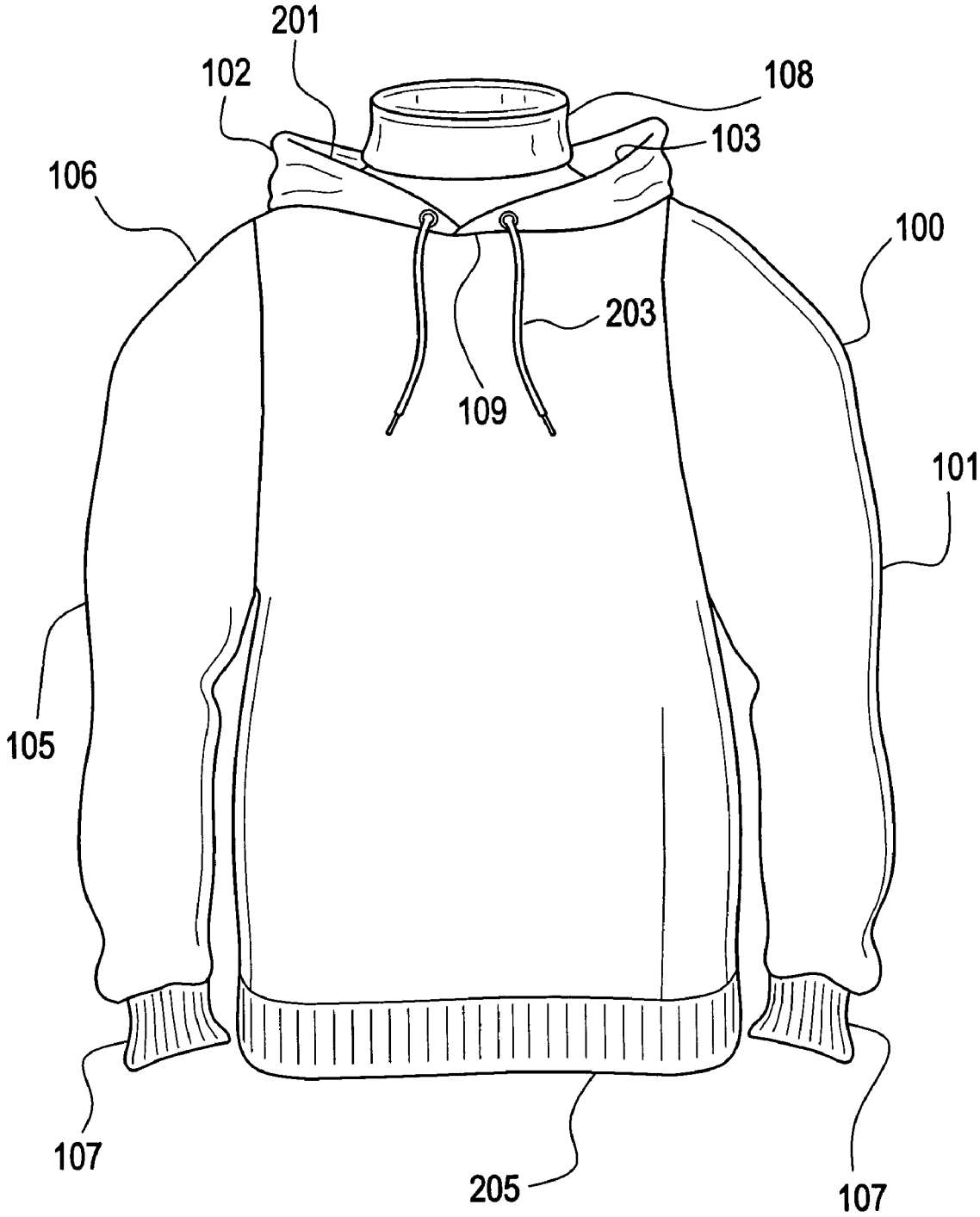
FIG. 6 is front view of a hooded garment with the stretchable tubular knitted collar in a retracted position and the hood in a down position, according to a preferred embodiment of the invention.
Figure 7:
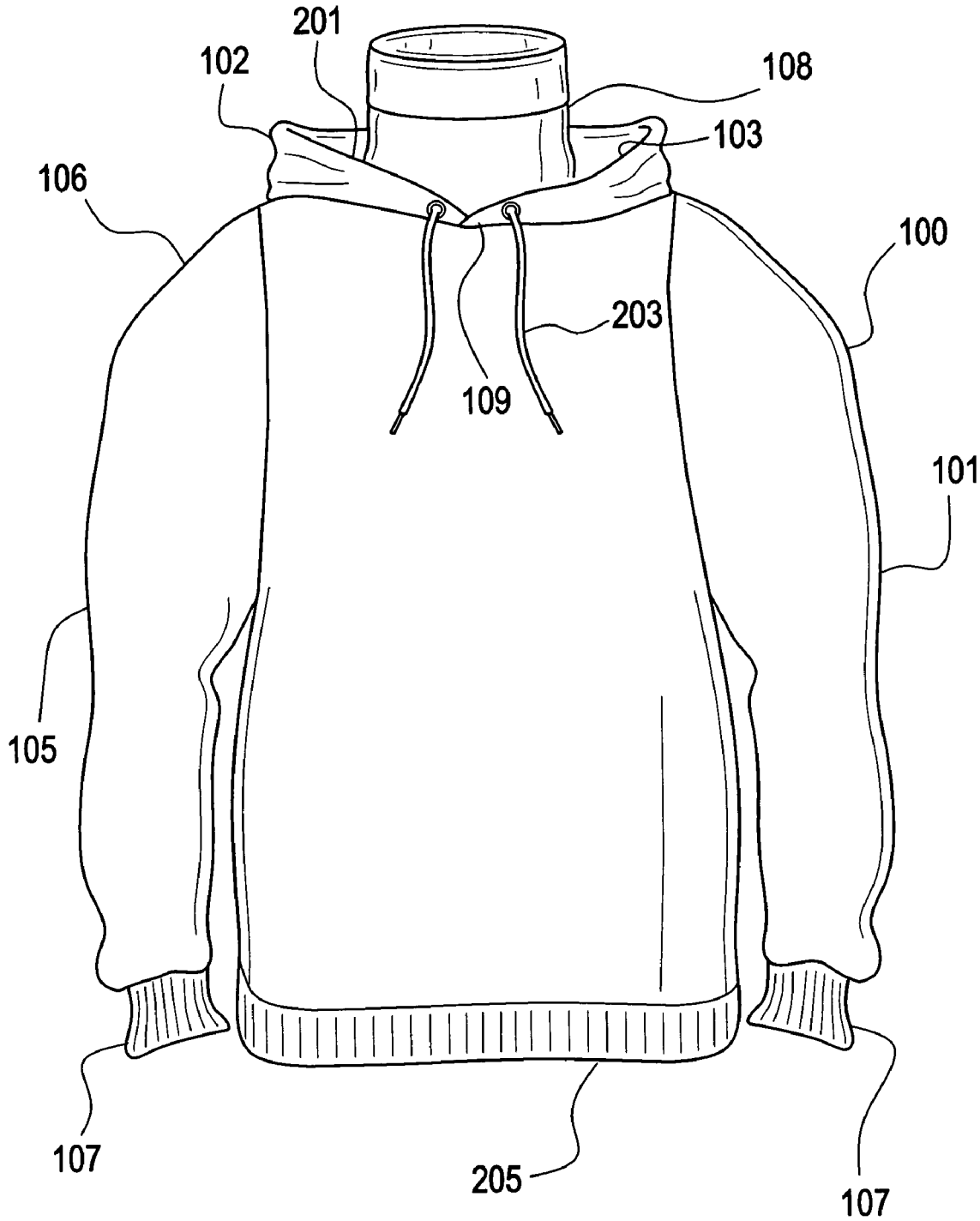
FIG. 7 is a front view of a hooded garment with the stretchable tubular knitted collar in an upward position and in an extended position with the hood in a down position, according to a preferred embodiment of the invention.
Figure 8:
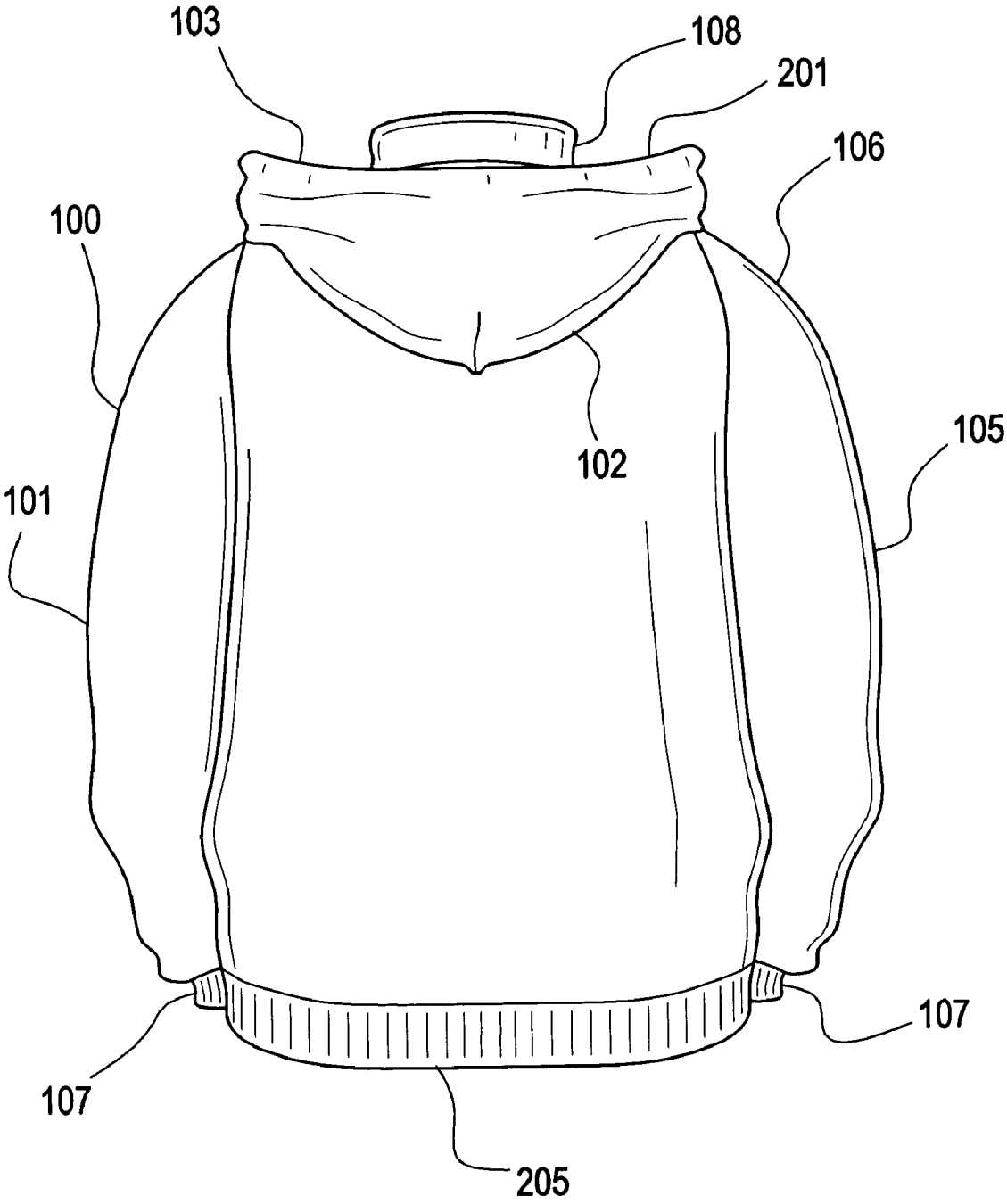
FIG. 8 is a back view of a hooded garment with the hood in a down position and the stretchable tubular knitted collar in a retracted position, according to a preferred embodiment of the invention.
Figure 9:
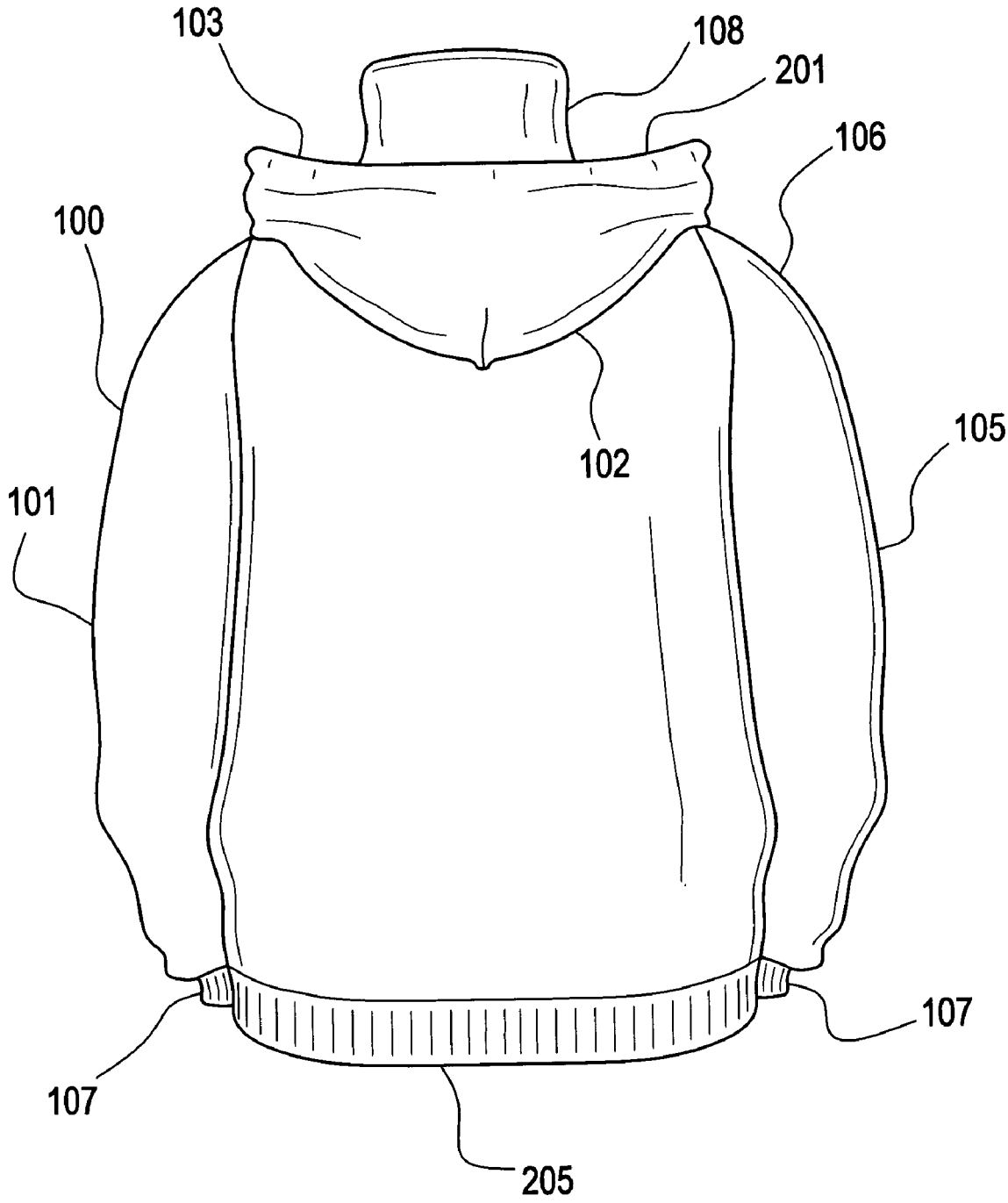
FIG. 9 is a back view of a hooded garment with the collar in an upward extended position and the hood in a downward position, according to a preferred embodiment of the invention.

FIG. 5 shows the back view of the hooded garment with the hood 102 in an upward position. As shown there, the collar 108 does not affect the hood's 102 ability to be extended or retracted.

FIGS. 6, 7, 8 and 9 all show the front and back views of the garment 100 with the stretchable tubular knitted collar 108 in the retracted and extended positions with the hood 102 in a down position. As reflected by these various views, the position of the hood does not restrict the variable positioning of the collar 108 about the user's neck and face to achieve the desired result and protection.

By having an integrally formed combination of a garment body, circular knitted flexible collar 108, and hood 102, a user may adjust the garment for wearing in a wider range of conditions and temperatures than conventional apparel.

In a method for manufacturing a preferred embodiment, the various elements are principally made from one type of fabric, although various fabrics may be used in combination to form any one of the elements.

Conventional methods are known for patterning and constructing the body of a sweatshirt or other outer wear garment.

In contrast with conventional methods, the hood and circular knitted collar are created as an integral unit and then attached to the garment body. The circular knitted neck is positioned inside the hood and the combination of the two elements is sewn about the neck opening of the main body portion of the garment.

In this preferred embodiment, the process for assembling the garment is extremely efficient since it does not require two steps in order to attach the collar and hood with the garment. By placing the collar within the hood prior to the sewing operation, the combination may be sewn to the garment body about neck opening in a single step which saves time and is more cost efficient.

Optionally, other design elements may be added to the garment. For example, in one preferred embodiment, the garment may have a central pocket attached to the front of the garment for placing the hands.

The present invention has been described in terms of specific embodiments incorporating details to facilitate understanding the principles of construction and operation of the invention. Such reference herein to specific embodiments and details thereof is not intended to limit the scope of the claims appended thereto. It will be apparent to those skilled in the art that modifications may be made in the embodiment chosen for illustration without departing from the spirit and scope of the invention.

What is claimed is:

1. A garment, comprising:

a garment body having a neck opening and sleeves;

a hood attached by stitching to the garment body; and a stretchable tubular knitted collar having a continuous enclosed surface for engaging the neck of a wearer and a bottom edge attached to the garment body along a substantial portion of the circumference of the bottom edge, said collar having a sufficient height to cover a substantial portion of a wearer's neck in a folded position and to cover a portion of a wearer's face in an unfolded position.

2. The garment of claim 1, wherein the collar is dimensioned to cover a portion of the neck and the face of a wearer.

3. The garment of claim 2, wherein the collar is dimensioned to cover a portion of the neck and the face of a wearer while a hood is extended over a user's head.

4. The garment of claim 2, wherein the collar is dimensioned to cover a portion of the neck and the face of a wearer while a hood is retracted from a user's head.

5. The garment of claim 1, wherein the garment body is made of a tubular knitted fleece.

6. The garment of claim 5, where a portion of the bottom edge of the hood overlaps when attached to the garment body along the entire neck opening.

7. The garment of claim 1, wherein the garment body is made of a tubular knitted fabric.

8. The garment of claim 1, wherein a bottom edge of the hood is attached to the garment body along the entire neck opening.

9. The garment of claim 1, wherein the garment body including a front panel and a rear panel, each having a lower edge, said front and rear panels being attached to one another along corresponding peripheral edge portions to define the neck opening and a bottom opening surrounded by lower edges of the front and rear panels.

10. A hooded sweatshirt, comprising:

a garment body having a neck opening and sleeves;

a hood, adapted to be worn over a user's head, attached by stitching to the garment body; and a stretchable tubular knitted collar having a continuous enclosed surface for engaging the neck of the wearer and a bottom edge attached to the garment body along a substantial portion of the circumference of the bottom edge, said collar having a sufficient height to cover a substantial portion of a wearer's neck in a folded position and to cover a portion of a wearer's face in an unfolded position.

* * * * *